US005165685A

United States Patent [19]

Hynes

[11] Patent Number: 5,165,685

[45] Date of Patent: Nov. 24, 1992

[54] GAME BALL

[76] Inventor: John P. Hynes, 20 Reservation Rd., Milton, Mass. 02186

[21] Appl. No.: 817,328

[22] Filed: Jan. 6, 1992

[51] Int. Cl.[5] ..... A63B 41/08

[52] U.S. Cl. ..... 273/65 EG; 40/327

[58] Field of Search ..... 273/65 EG, 26 R, 26 D, 273/58 K, 58 A, 58 B, 58 BA, 60 R, 60 B; 40/327; D21/204, 205

[56] References Cited

U.S. PATENT DOCUMENTS

D. 264,365 5/1982 Arino ..... D21/205
D. 284,493 7/1986 King ..... D21/204
3,863,923 2/1975 Anderson ..... 273/65 EG
4,318,544 3/1982 Brine ..... 273/65 EG

*Primary Examiner*—George J. Marlo
*Attorney, Agent, or Firm*—Joseph H. Killion

[57] ABSTRACT

A game ball, such as a basketball, which includes a pair of raised or indented substantially circular polar seams disposed around each pole of the game ball and a plurality of raised or indented substantially circular seams disposed about the equatorial circumference of the game ball and further being tangentially connected to both substantially circular polar seams. An athlete is able to grip the seams with up to five fingers to facilitate gripping and controlling the ball.

4 Claims, 2 Drawing Sheets

GAME BALL

BACKGROUND OF THE INVENTION

Basketball is one of the sports which utilizes a seamed game ball made from leather, rubber or various polYmeric materials.

Early manufacturing processes utilized strips of leather which were sewn together and secured to a bladder. This stitching created a rough raised or indented seam between the strips.

As rubber and other polymerics supplemented leather, manufacturing processes evolved which could eliminate seams. Seams, however, had become necessary and relied upon by athletes for gripping and controlling the game ball.

In baseball, for example, the raised seams allow the pitcher to grasp the ball and by varying his grip throw a fastball, curve, or many other pitches.

In basketball, the channel seams serve several purposes to the athlete leading the athlete to position his fingers in contact with a seam or seams whenever possible. When the athlete bounces the ball, the seams afford the athlete control over the ball's rotation, direction and other handling characteristics. When the athlete holds the ball, the seams provide a surer grip; when he passes the ball, the seams provide more accurate control over the ball's release and direction. When the athlete shoots at the basket he uses the seams to control the release point, rotation, velocity and trajectory of the ball. The seams also provide feedback to the player about the alignment of the shot through the uniformacy of the rotation of its seams.

There are a number of inventions which actually utilize the seams for a variety of purposes, both instructive and utilitarian.

U.S. Pat. No. 3,858,876, teaches the providing of gripping indicia on the surface of the ball to aid the athlete in locating his hands and fingers in essentially the same manner each time before shooting the basketball.

U.S. Pat. No. 4,345,759, discloses a single circumferential 360° line around the periphery on the center of the ball. The athlete can focus on the line throughout the entire shot and observe what corrections are necessary on subsequent shots. Accordingly, the seams are very important to the athlete in affording the athlete maximum control in making his shot and to provide feedback to the athlete for adjustment to increase the effectiveness of the control he imparts to the ball.

SUMMARY OF INVENTION

My invention relates to an improved game ball.

I have discovered an improved game ball which comprises a pair of substantially circular polar seams, one of which is disposed around each pole of the game ball. A plurality of substantially circular tangential seams are disposed about the equatorial circumference of the game ball tangentially connected to both substantially circular polar seams.

Preferably, but optionally, at each tangential connection of the seams a joint seam of substantially single width is formed.

Also preferably, but optionally, the circular seams are all of substantially the same diameter.

The game ball may be made of a number of materials including leather, rubber or other polymeric material, which makes the configuration readily moldable.

My invention provides numerous advantages over the devices found in the prior art. On the present game balls, particularly basketballs, it is difficult for the athlete to get more than two fingers on the seam when preparing to shoot or dribble. On the present game balls, particularly basketballs, it is difficult seam when preparing to shoot or dribble. Applicant's invention allows the athlete to get up to five fingertips on a seam.

Another advantge of my invention is that the observed uniformity or rotation of the seams while the shot is in the air provide feedback to the athlete about his alignment and hand position during the shot.

Further advantages of my invention are that it is stable while in use, simple to manufacture, efficient and economical.

DETAILED DESCRIPTION OF THE DRAWINGS

Figure 1:
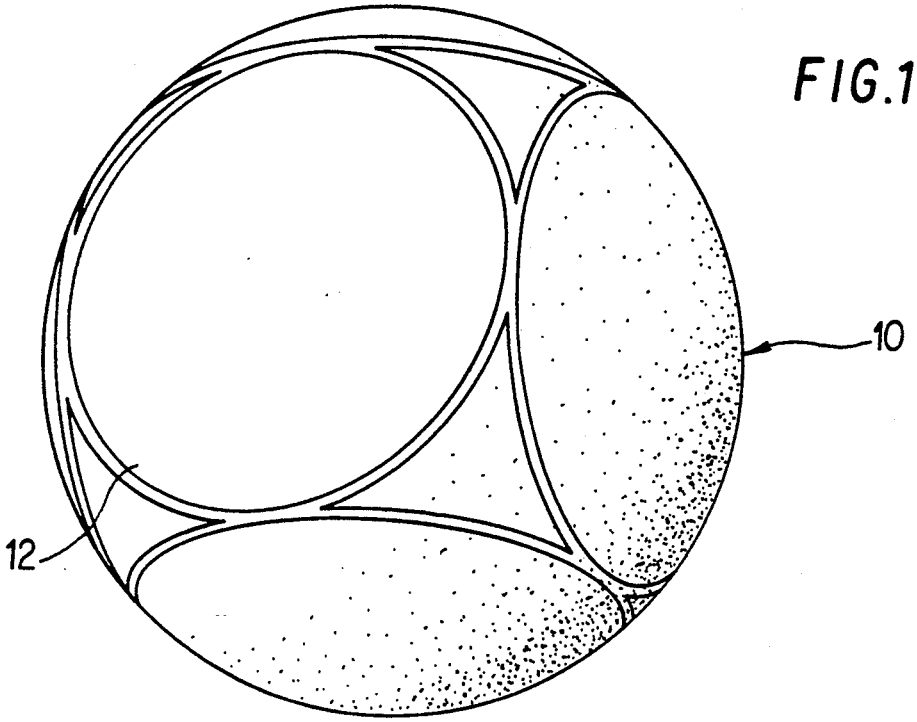
FIG. 1 is a perspective top view of a game ball illustrating the substantially circular polar seam means.

Referring now in particular to the accompanying drawings my improved game ball is generally indicated in FIG. 1 at 10 with substantially circular polar seam means 12 at one pole of the improved game ball 10. Another substantially circular interconnected seams means (not shown) surround the other pole (not shown) of the improved game ball.

Figure 2:
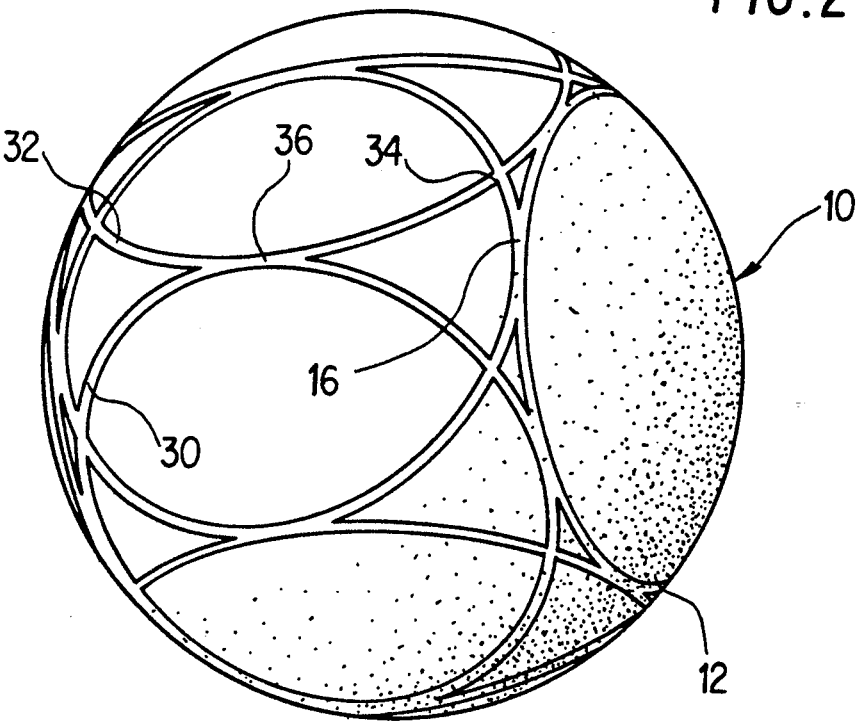
FIG. 2 is a side perspective view of the game ball alternating the plurality of substantially circular interconnected seam means as they are disposed about the circumference of the game ball.

FIG. 2 includes a plurality of substantially circular interconnected seams means 30, 32, around the equatorial circumference of the game ball. The plurality of substantially circular interconnected seams means connect with each substantially circular polar seam means at points 16 (some not shown) where the seam forms a seam of substantially normal width. Further, each substantially circular interconnected seams means overlaps to form substantially congruent arches and meets at centerpoints 36 (some not shown) to form a seam of substantially normal width and at endpoints 34 (some not shown) to form a seam of substantially normal width.

Figure 3:
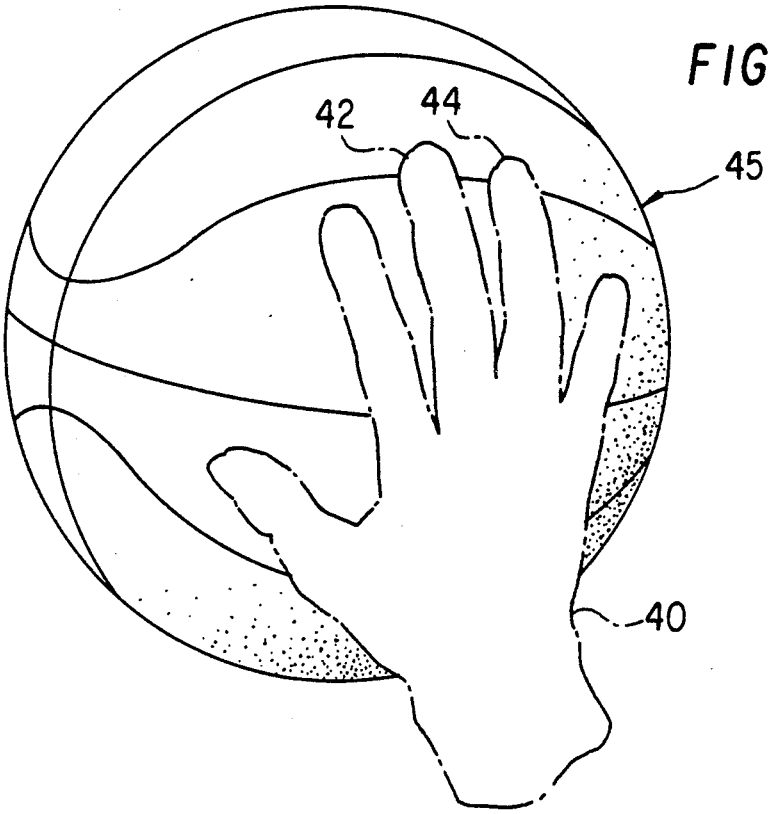
FIG. 3 is an illustration showing an athlete positioning two of his fingertips in contact with a seam of a prior art game ball.

In FIG. 3, the athlete's hand 40, has fingertips 42, 44, on a seam of the game ball 45.

Figure 4:
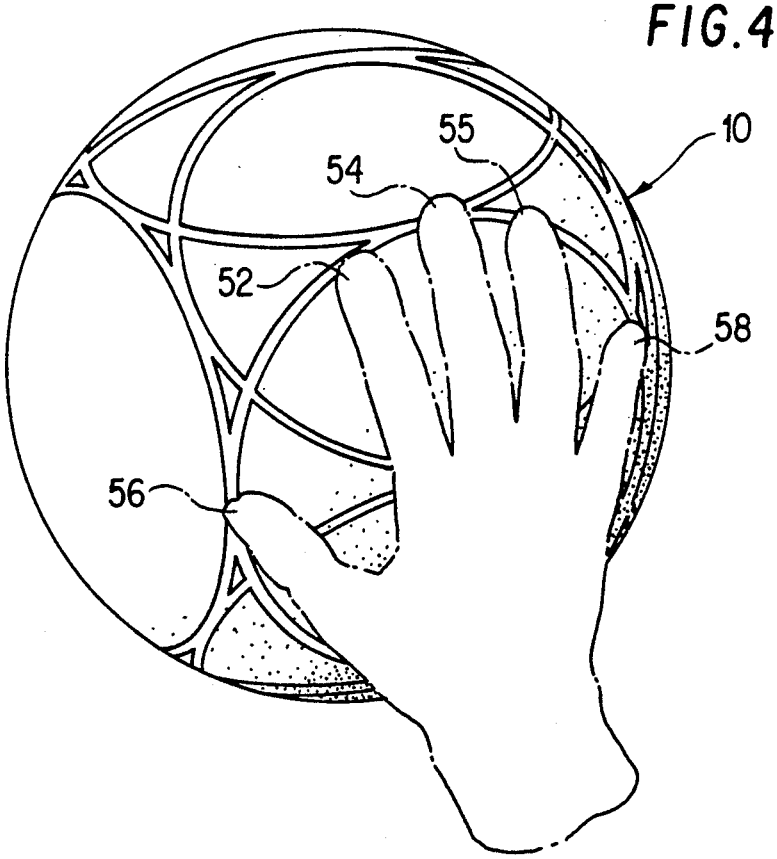
FIG. 4 is an illustration showing an athlete positioning five of his fingertips in contact with a seam of the improved game ball.

In FIG. 4, the athlete's hand 50, has fingertips 52, 54, 55, 56, 58 on the improved game ball 10.

Typically in use the improved game ball is passed to the athlete who only has to shift the improved game ball to get five fingers on the seams giving him greater control whether he passes, dribbles or shoots.

The preferred embodiment is a basketball and is only illustrative of my improved game ball.

The foregoing detailed description has been given for clearness of understanding only and no unnecessary limitations should be understood therefrom as some modifications will be obvious to those skilled in the art.

What I claim is:

1. An improved game ball comprising:

(a) a pair of substantially circular polar seam means one of which is disposed around each pole of said game ball;

(b) a plurality of substantially circular interconnected seam means disposed about the equatorial circumference of said game, ball and tangentially connected to both said substantially circular polar seam means, and each of said seam means defining a raised or indented formation which permits an athlete to grip the seams with up to five fingers to facilitate gripping and controlling the ball.

2. The improved game ball of claim 1 further comprising at each connection of said seam means the formation of a seam of single width.

3. The improved game ball of claim 1 wherein all said circular seam means encompass substantially the same area.

4. The improved game ball of claim 1 wherein substantially circular seam means are tangentially disposed about said equatorial circumference of said game ball tangentially connected to both substantially circular polar seam means.

* * * * *